US007581538B2

(12) United States Patent
Kelly et al.

(10) Patent No.: US 7,581,538 B2
(45) Date of Patent: Sep. 1, 2009

(54) BALL PROPELLING MACHINE

(76) Inventors: Haydn Kelly, 147 Springvale Drive, Weetangera, Australian Capital Territory, 2614 (AU); Colin Brodrick, 6 Fernleigh Drive, Googong, NSW 2620 (AU)

( * ) Notice: Subject to any disclaimer, the term of this patent is extended or adjusted under 35 U.S.C. 154(b) by 358 days.

(21) Appl. No.: 10/591,138

(22) PCT Filed: Mar. 11, 2005

(86) PCT No.: PCT/AU2005/000338

§ 371 (c)(1),
(2), (4) Date: Aug. 29, 2006

(87) PCT Pub. No.: WO2005/087328

PCT Pub. Date: Sep. 22, 2005

(65) Prior Publication Data

US 2007/0191143 A1 Aug. 16, 2007

(30) Foreign Application Priority Data

Mar. 12, 2004 (AU) ..... 2004901316
Aug. 3, 2004 (AU) ..... 2004904357

(51) Int. Cl.
*F41B 11/00* (2006.01)

(52) U.S. Cl. ..... 124/81; 124/56

(58) Field of Classification Search ..... 124/56, 124/73, 81; 473/451
See application file for complete search history.

(56) References Cited

U.S. PATENT DOCUMENTS

| | | | | |
|---|---|---|---|---|
| 2,005,787 | A * | 6/1935 | Humphrey | 101/114 |
| 3,662,729 | A * | 5/1972 | Henderson | 124/73 |
| 4,501,257 | A * | 2/1985 | Kholin | 124/81 |
| 4,523,573 | A * | 6/1985 | Defosse et al. | 124/41.1 |
| 5,224,701 | A * | 7/1993 | Sciarrillo et al. | 124/73 |
| 5,447,144 | A * | 9/1995 | Ivy | 124/26 |
| 6,471,606 | B1 * | 10/2002 | Simpson | 473/451 |
| 2004/0083639 | A1 * | 5/2004 | Strayn | 42/106 |

FOREIGN PATENT DOCUMENTS

| | | |
|---|---|---|
| WO | WO 96/03184 | 2/1996 |
| WO | WO 2004/024246 | 3/2004 |

* cited by examiner

*Primary Examiner*—John Ricci
(74) *Attorney, Agent, or Firm*—Steven A. Nielsen; Allman R Nielsen, P.C.

(57) ABSTRACT

The invention relates to an assembly and method of spinning a seamed ball prior to being propelled from a ball propelling machine. The assembly can simulate balls propelled in sports such as baseball. The assembly includes at least one pair of opposed ball supports to firstly position a loaded ball in a predetermined alignment and to subsequently apply a predetermined amount of spin to the ball prior to being fired from the assembly.

17 Claims, 14 Drawing Sheets

BALL PROPELLING MACHINE

CROSS-REFERENCE TO A RELATED APPLICATION

This application is a National Stage Application of International Application Number PCT/AU2005/000338, filed Mar. 11, 2005; which claims priority to Australian Applications Nos. 2004901316, filed Mar. 12, 2004 and 2004904357, filed Aug. 3, 2004.

FIELD OF THE INVENTION

The invention relates to a machine and method of propelling a ball to simulate balls propelled in sports such as baseball. More particularly, the present invention relates to an assembly and method of spinning a ball prior to being propelled from a ball propelling machine. The balls are preferably seamed.

BACKGROUND ART

For many years ball propelling machines have been used as a training aid in a variety of sports. There are a number of different types of ball propelling machine presently available. However, three forms of ball propelling machine dominate the market. One type uses a pair of counter-rotating wheels to propel the ball, another uses a mechanical arm to throw the ball, and a third uses expanding gas, such as compressed air, to propel the ball from the machine.

U.S. Pat. No. 6,202,636 is an example of the third type, and describes a pitching machine which relies on expanding gas to propel a ball down a barrel towards an intended target. Some variability in the amount of spin imparted to the ball can be achieved by means of an adjustable friction surface which forms a portion of the barrel. Seamed balls such as baseballs are usually pitched in either a two or four seam (stitching) position, yet this is not taken into account in this machine. Accordingly, there exists a need in the art for a ball propelling machine that offers advantages in terms of ease of use and/or flexibility in terms of imparting spin and/or velocity to a baseball or the like propelled therefrom.

SUMMARY OF INVENTION

This invention aims to provide an alternative to known ball propelling machines and methods.

In one aspect this invention resides broadly in a ball propelling assembly for propelling a ball having a seam, the assembly including:—

- a ball positioner having opposed ball supports which engage and rotate the ball which thereby moves relative to the ball supports until positioned relative thereto in a predetermined alignment;
- a ball spinner having opposed ball supports which engage and spin the ball in the predetermined alignment, and
- a ball propeller which propels the spinning ball from the assembly along an axis of propulsion.

Preferably, the ball spinner includes two pairs of opposed ball supports, the pairs being aligned to each other at right angles. Preferably, one of the opposed pairs comprises the pair of opposed ball supports in the ball positioner. Preferably, one of the opposed pairs comprises the pair of opposed ball supports in the ball spinner.

Preferably, the ball supports can be advanced towards and retracted away from a loaded ball. Preferably, the assembly includes a motor which rotates and/or spins the ball supports.

Preferably, the portion of each ball support that comes into contact with the ball has a substantially concave face. More preferably, the concave face has a plurality of adjacent scallops or grooves which meet at peaks on the rim of the face.

Preferably, the predetermined alignment is either such that the ball is positioned to be propelled with a two seam spin, or is propelled with a four seam spin. Preferably, the predetermined alignment is such that the ball is not engaged by the opposed ball supports on the seam of the ball.

In another aspect, the present invention resides in a method of propelling a ball having a seam, the method including:—

- engaging and rotating the ball by a ball positioner having opposed ball supports, the ball thereby moving relative to the ball supports until positioned relative thereto in a predetermined alignment;
- engaging and spinning the ball engaged thereby in the predetermined alignment by a ball spinner having opposed ball supports, and
- propelling the spinning ball from the assembly along an axis of propulsion by a ball propeller.

In a further aspect, the present invention resides in an assembly comprising at least one pair of opposing ball supports, wherein rotation of the ball supports causes a loaded baseball to rotate about a predetermined axis, wherein the pressure exerted by the ball supports on the baseball is insufficient to prevent the axis of rotation of the baseball changing whilst being rotated and the baseball adopting the predetermined axis of rotation.

Preferably, the pair of opposing ball supports can move from a retracted position where they are not in contact with the baseball to an advanced position in which they are in contact with a loaded baseball. Preferably, the ball supports are advanced or retracted by a pneumatic piston or linear motor, and each of the ball supports is rotated by a separate motor.

Preferably, the baseball is aligned such that the axis of rotation is centred in, and extends through, one pair of the opposite loop shaped regions formed by the continuous stitched seam of the baseball. Preferably, the predetermined axis is either such that the ball is positioned to be propelled with a two seam spin, or is propelled with a four seam spin.

Preferably, a single pair of opposed ball supports firstly causes the baseball to rotate about a predetermined axis and thereafter apply a predetermined amount of spin to the baseball so as to be propelled in the two seam position. Alternatively, it is also preferred that a first pair of opposed ball supports firstly causes the baseball to rotate about a predetermined axis and thereafter a second pair of opposed ball supports apply a predetermined amount of spin to the baseball so as to be propelled in the four seam position. Preferably, the first pair of ball supports are rotated at a different speed to the second pair of ball supports.

Preferably, the opposing pair of ball supports contact the baseball with two to six kilograms of pressure when aligning the baseball to rotate about a predetermined axis of rotation. Preferably, the opposing pair of ball supports contact the baseball with twelve to eighteen kilograms of pressure when spinning the baseball in the two or four seam position.

Preferably, the ball supports have a substantially concave face which is capable of contacting the baseball. More preferably, the concave face has a plurality of adjacent scallops or grooves which meet at peaks on the rim of the face.

In a still further aspect, the present invention resides in a method of aligning a baseball in a baseball propelling machine comprising bringing a pair of opposing ball supports into contact with a baseball and rotating the ball supports until the baseball rotates about a predetermined axis, wherein the pressure exerted by the ball supports on the baseball is insufficient to prevent the axis of rotation of the baseball changing whilst being rotated and the baseball adopting the predetermined axis of rotation.

In a further aspect, the present invention resides in an expanding gas powered ball propelling machine, comprising a barrel, at least one ball support, at least one motor to rotate the at least one ball support, and wherein the ball support can be advanced and retracted towards a loaded ball.

While compressed air is preferred for propelling the baseball, it would be readily appreciated by the skilled addressee that other expanding gases may be used. For example, the ball machine could be used in conjunction with a combustible gas and ignition source.

Additional preferred features of the invention will be apparent from the dependant claims and from the following description of the preferred embodiment.

BRIEF DESCRIPTION OF DRAWINGS

The invention will now be described in a non-limiting manner with respect to a preferred embodiment in which:—

FIG. 10(*a*) is an exploded perspective view, FIG. 10(*b*) is a perspective view of the rear of the ball spinning assembly and FIG. 10(*c*) is a perspective view of the front of the assembly;

FIG. 11(*b*) is a perspective view of the assembled spinning assembly;

FIGS. 12(*b*) and 12(*c*) are elevations of the combined assembly and FIG. 12(*e*) is a plan view;

FIG. 13(*b*) is a perspective view of the assembled ball support and associated motor assembly of the ball spinning assembly; and, FIG. 14 is a perspective view of a pair of opposing ball supports of the ball spinning component of the ball propelling machine.

DETAILED DESCRIPTION OF PREFERRED EMBODIMENT

Baseballs are required to be thrown with the stitches/seam in a known orientation as this affects the movement of the ball through the air. If this is not taken into consideration and the balls are pitched randomly, the distance a spinning ball moves off-line will differ each time a ball is released. According to the present invention, identical spin in terms of both rate of revolution and axis of rotation can be applied to a ball propelled from the machine. Hence, it is possible to repeatedly simulate a desired type of pitch.

Figure 1:
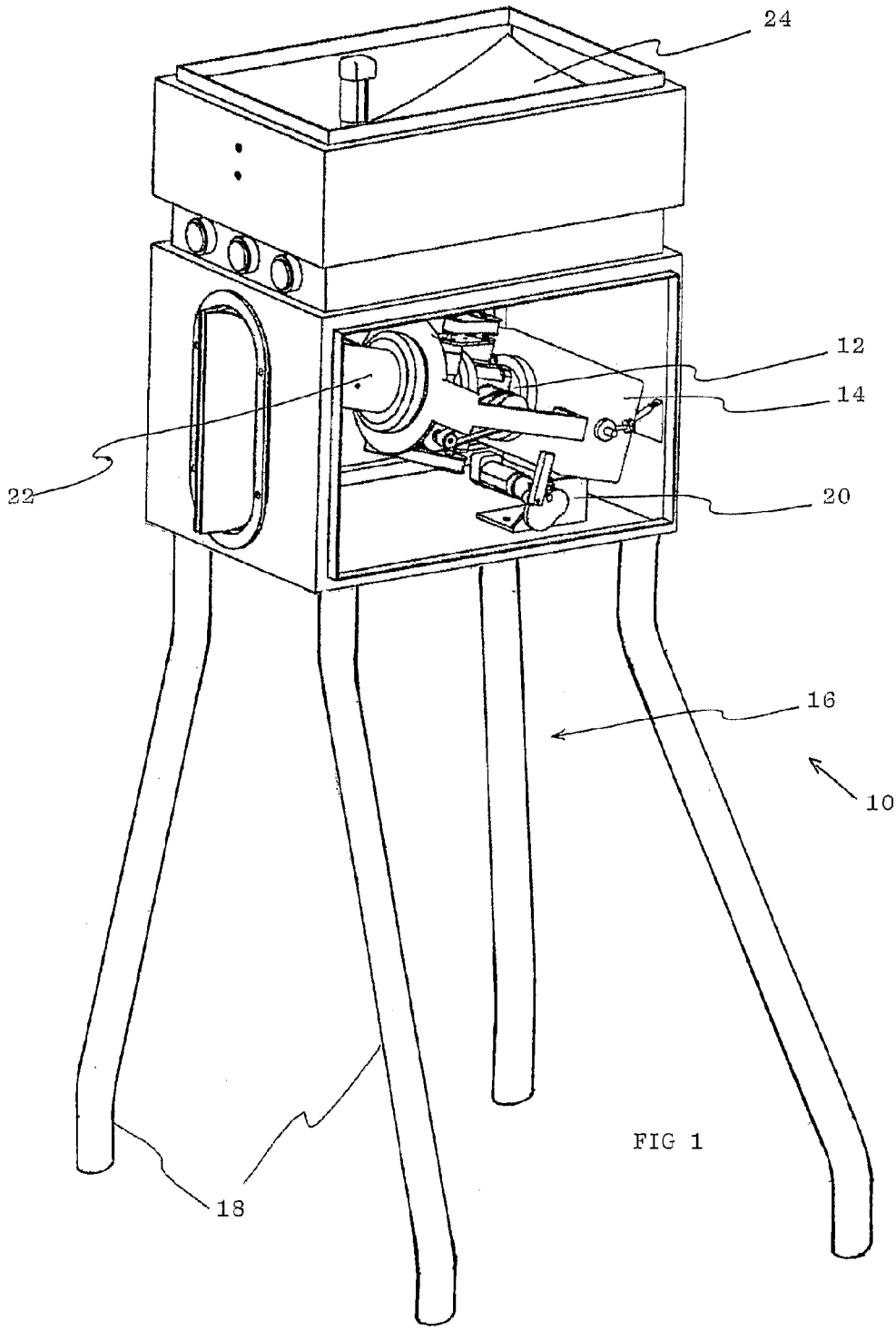
FIG. 1 is a perspective view of a ball propelling machine.

FIG. 1 shows one example of a ball propelling machine 10 that may utilise a ball spinning assembly according to the preferred embodiment of the present invention. Typically, the ball propelling machine will include a ball spinning assembly 12, ball firing component 14, stand 16 with legs 18, tilting mechanism 20, barrel 22 and ball feed 24. The ball firing component 14 is connected to a source of compressed gas, such as a cylinder of compressed air or powered compressor via an air inlet hose made of, for example, a flexible material such as rubber or plastic.

The main body components of the device, including the ball spinning assembly 12, may be constructed from a variety of suitable materials which include various metals, metal alloys or plastics. Varying the height of the stand, for example by the use of telescopic legs, varies the height of the machine from the playing surface and consequently the angle of descent of a ball propelled towards a target. Varying the height of the assembly allows for the replication of balls propelled from players of different height.

The ball propelling machine may have a ball feed 24 such as that depicted in FIG. 1. The ball feed can be of any practical size and may be used to hold one or more balls prior to a ball entering the ball spinning assembly. The ball feed may be used in conjunction with a signalling device, so that the player has appropriate warning that a ball is about to be propelled. According to the preferred embodiment of the present invention, the ball propelling machine is loaded by raising the open end of the barrel towards the ball feed and allowing a ball from the ball feed to roll directly into the open end of the barrel and subsequently into the ball spinning assembly. The open end of the barrel can then be lowered to aim at the target prior to firing.

In operation, a ball is positioned in ball spinning assembly 12. Compressed air is supplied to, and optionally stored in, ball firing component 14. Upon firing, compressed air forces the ball from ball spinning assembly 12 through barrel 22 toward the target.

FIGS. 2 to 9 depict a schematic view of the ball spinning assembly of the present invention. FIGS. 2 to 9 illustrate how a baseball can have its seam aligned and subsequently spun by the ball spinning assembly of the present invention prior to firing. In this way, the different types of spin imparted by a baseball pitcher can be substantially replicated by the ball spinning assembly of the present invention.

FIGS. 2 to 9 schematically illustrate the ball spinning assembly 12, including four ball supports 28A, 28B, 28C and 28D. In use, ball supports 28A, 28B, 28C and 28D initially are in a retracted position, and a ball 26 comes to rest between the ball supports of the ball spinning component 12. The ball can enter the barrel 22 of the ball spinning assembly 12 by either being loaded directly into the end of the barrel 22 as depicted in FIG. 1 or via a separate breach opening in the barrel.

Figure 2:
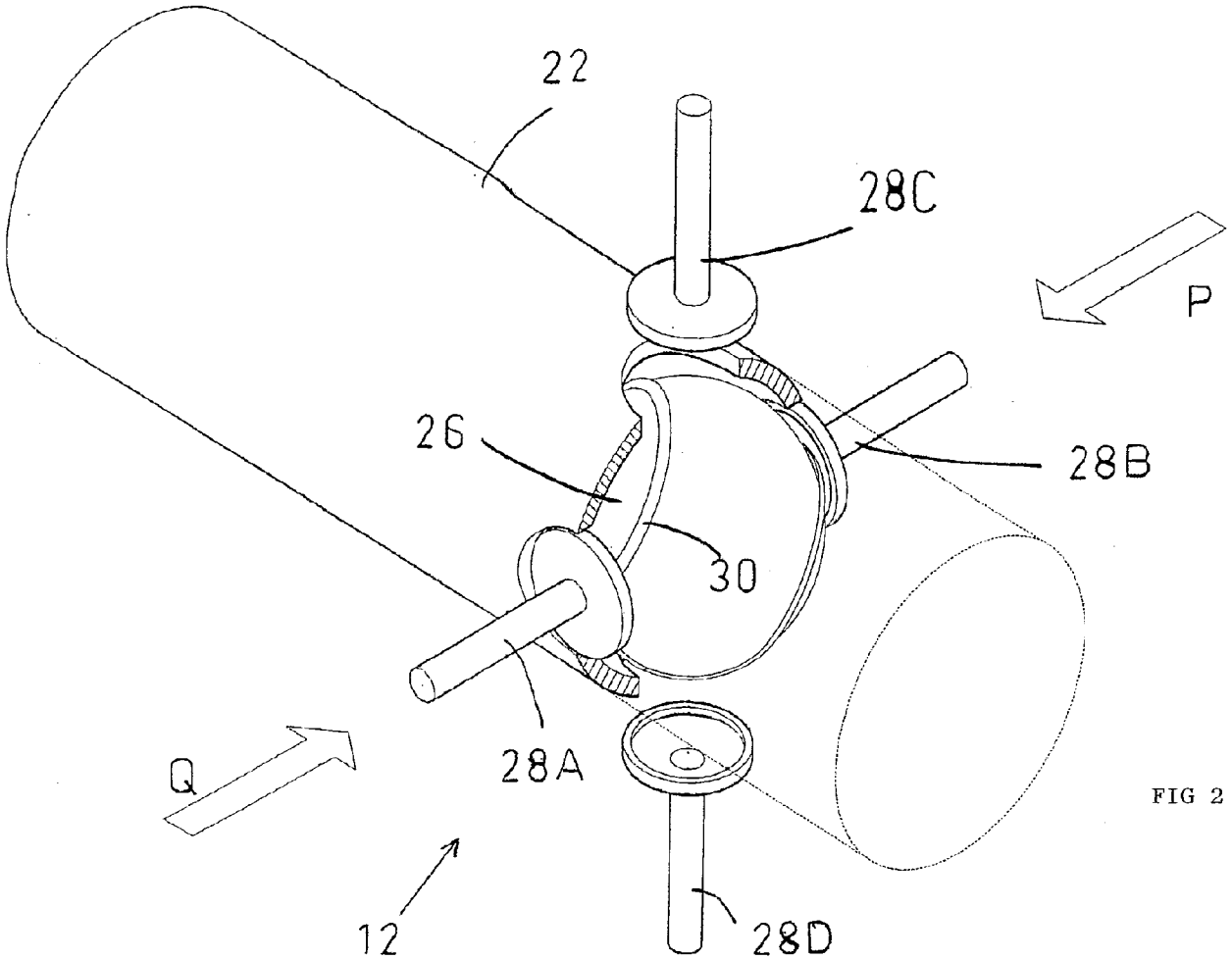
FIGS. 2 to 9 are schematic views of the ball spinning assembly of the present invention illustrating various spinning operations.
Figure 9:
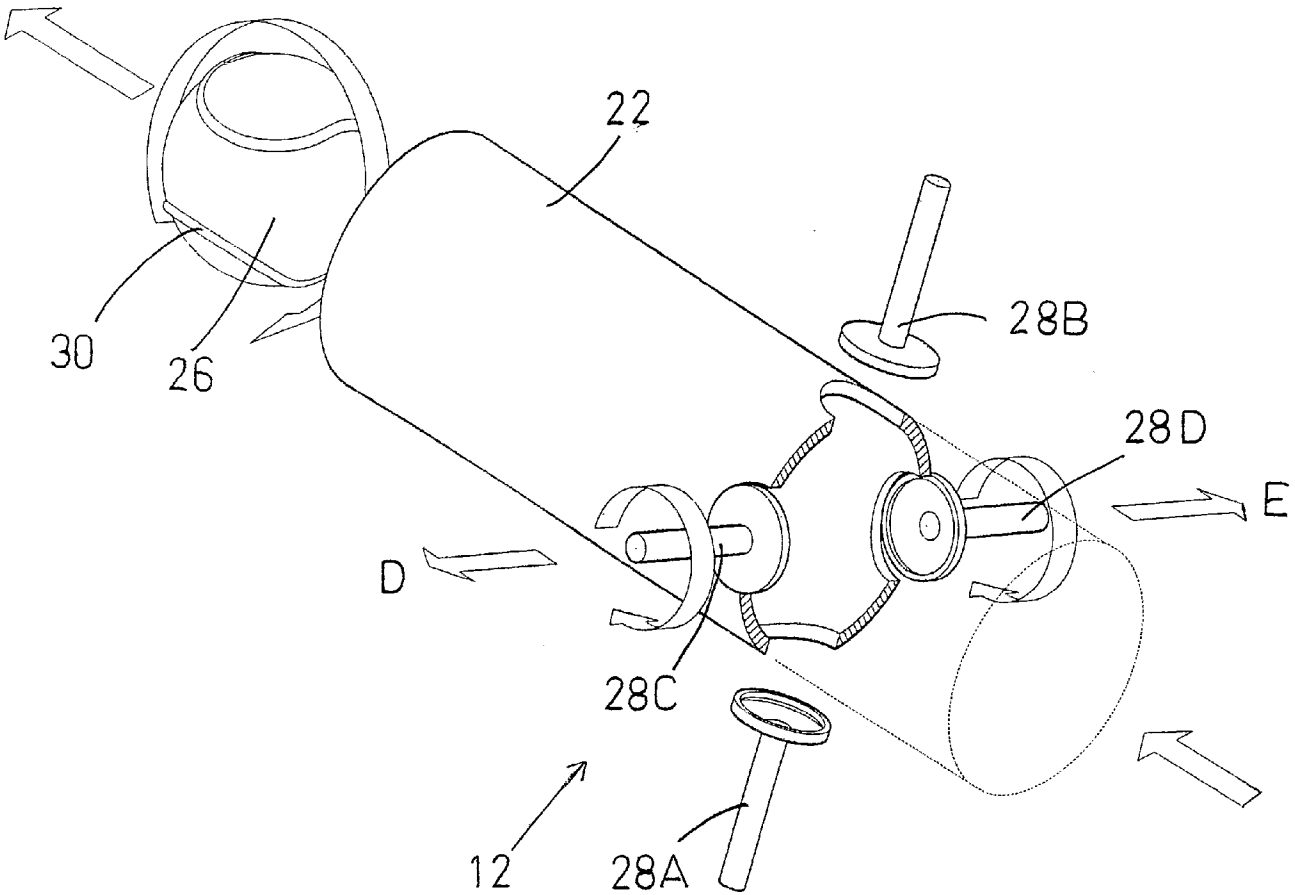

As depicted in FIG. 2, once a ball is positioned in the ball spinning assembly, an opposing pair of ball supports 28A, 28B move towards each other as indicated by directional arrows P and Q and come into contact with the ball. As depicted in FIG. 2, ball supports 28A, 28B are preferred as these are horizontal, rather than ball supports 28C, 28D which are vertical. However, if the barrel is rotated 90 degrees as depicted in FIG. 9, the ball supports 28C, 28D are then preferred as 28C, 28D are now horizontal.

Figure 3:
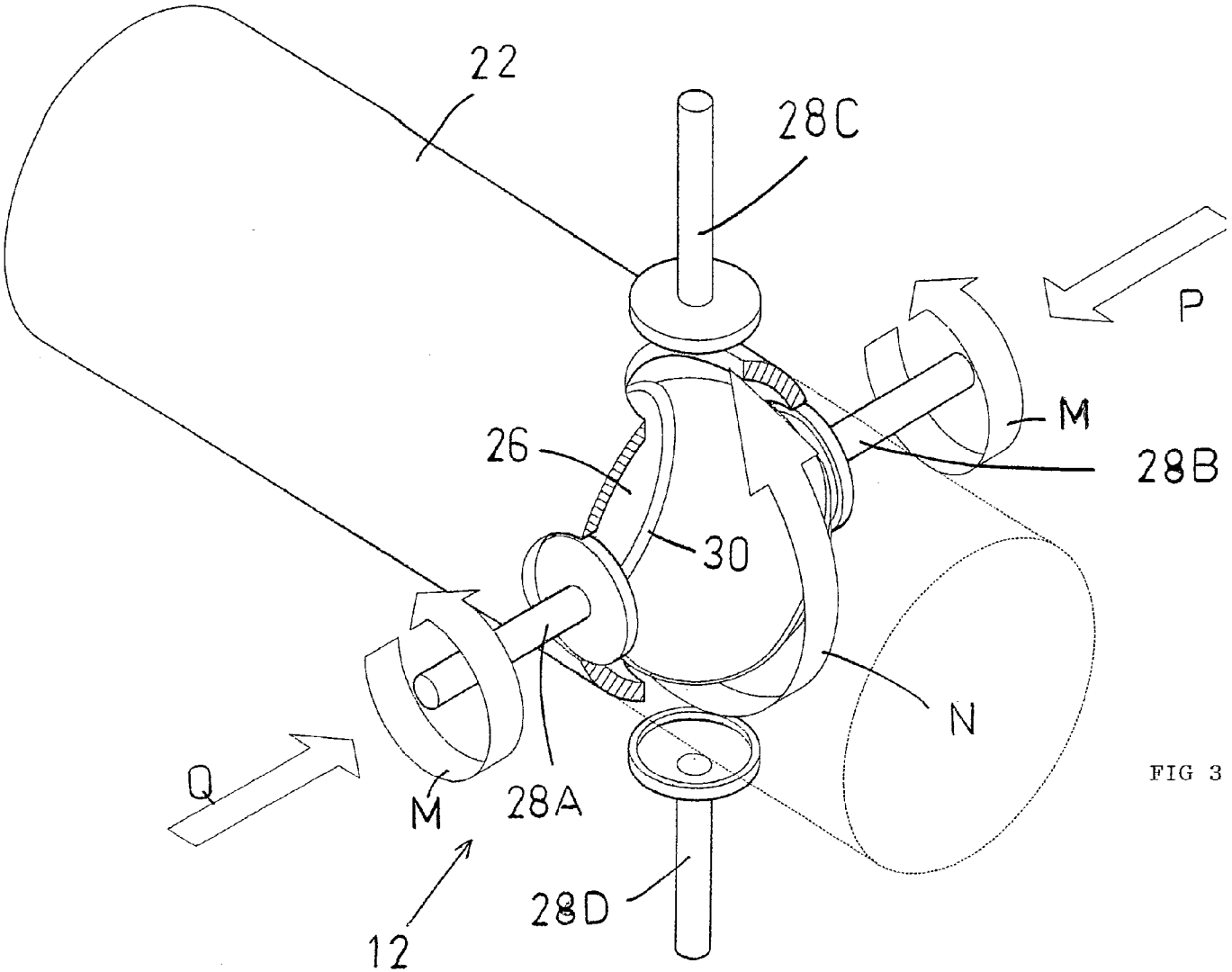

Referring to FIG. 3, the opposing pair of ball supports 28A, 28B have been brought into contact with the ball 26 and are rotated in the direction as indicated by arrows M to thereby spin the ball as indicated by arrow N.

Figure 4:
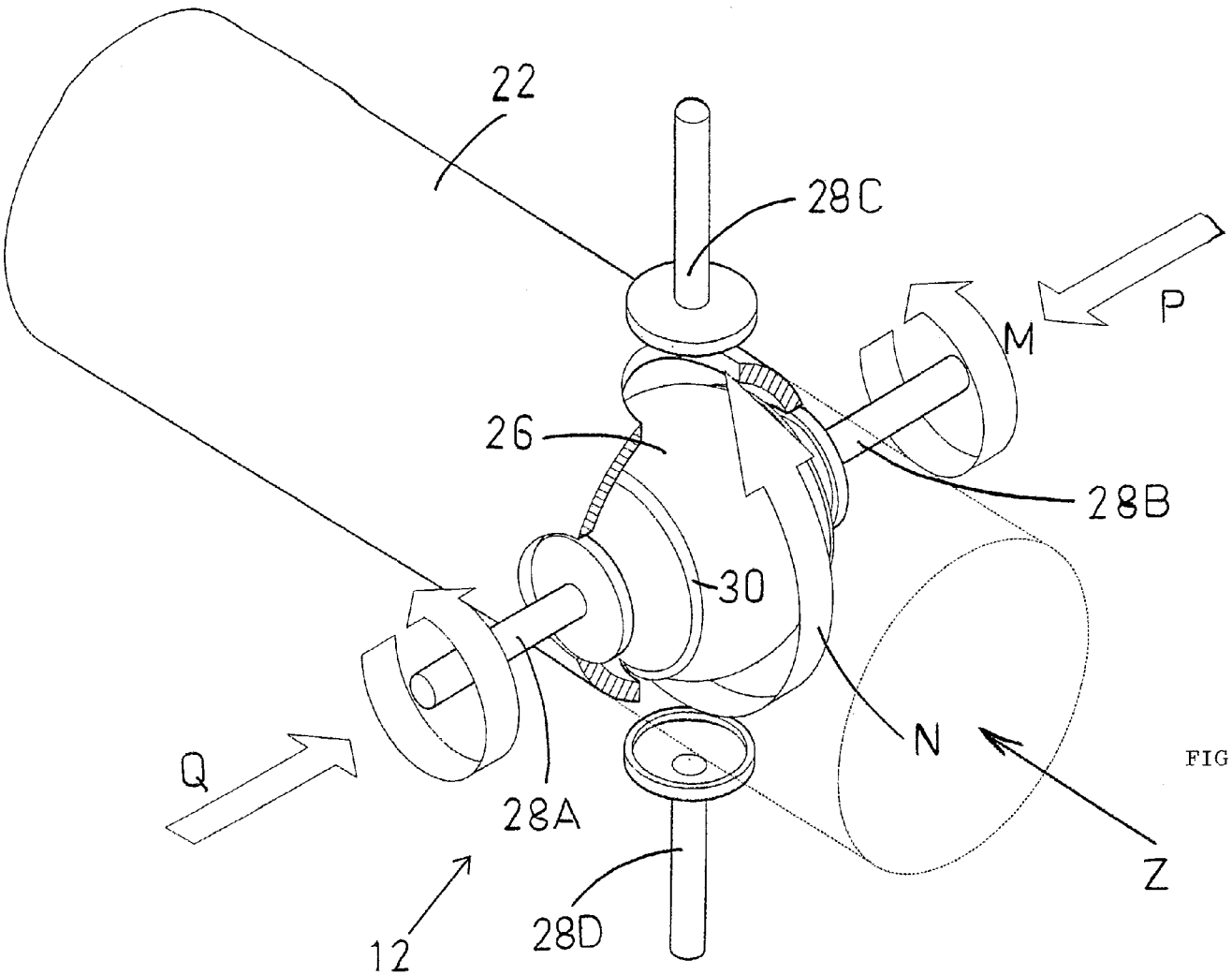

It has been found by the present inventors that if the opposing pair of ball supports 28A, 28B loosely grip and spin the baseball, the surface of the ball will move relative to the ball supports until the ball is gripped by the ball supports so as not to contact the stitching of the ball, but rather contact the ball in two of the loop shaped regions of the continuous stitched seam. The ball will settle in this position irrespective of how it is initially grasped by the supports. An aligned ball is depicted in FIG. 4. While not wishing to be bound by this theory, it is possible that slight differences in ball circumference and/or weight of the ball due to the raised stitching may be the reason why this occurs. It is important to note that if the ball is gripped too tightly by ball supports 28A, 28B, the ball will not be able to move relative to the ball supports and adopt the "aligned" position.

Typically, to align the ball the ball supports are rotated at about 2700 rpm, with each ball support exerting about two to about six kilograms of pressure on the ball. Alternative rotational speeds and/or pressure used to grip the spinning ball can be readily ascertained by experimentation.

Figure 5:
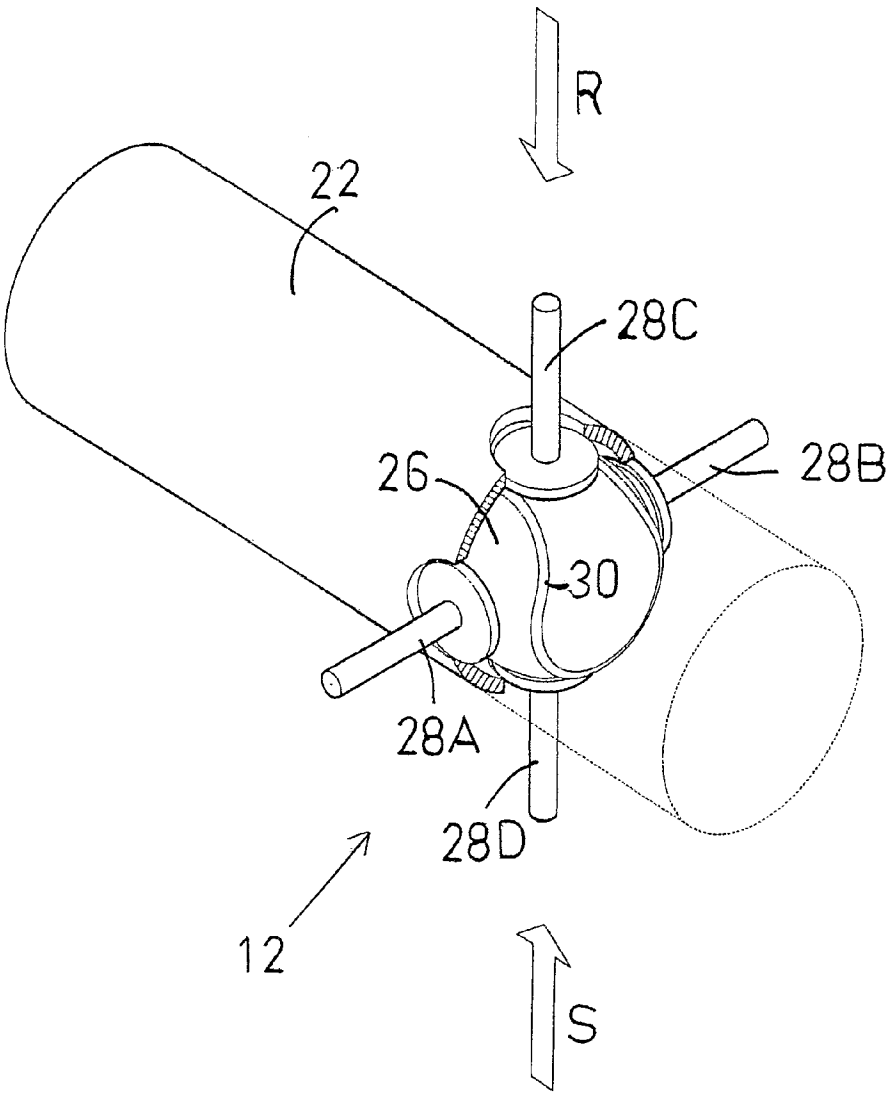
Figure 6:
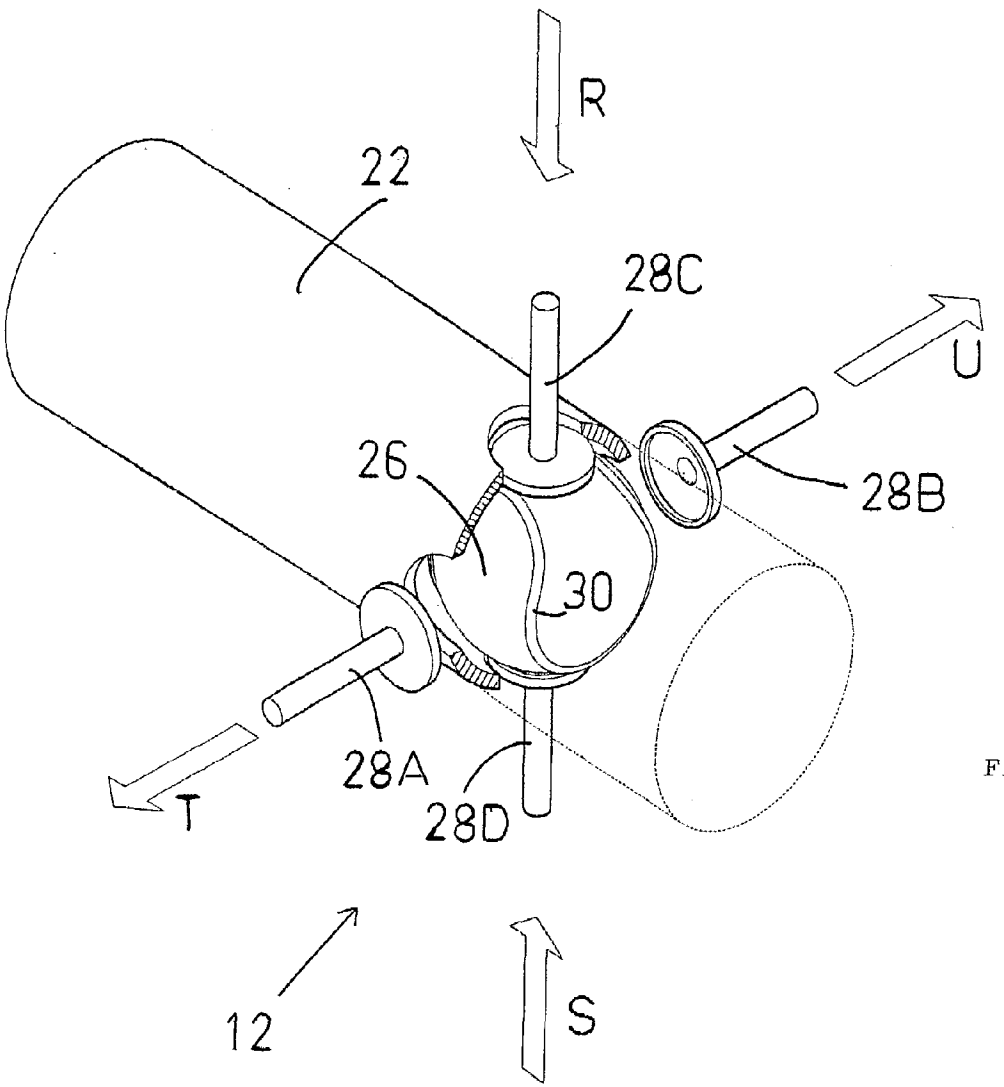

Once the ball has been aligned, either pair of opposed ball supports 28A, 28B or 28C, 28D can be employed to apply a predetermined amount of spin to the aligned ball. For example, in FIG. 4 ball supports 28A, 28B which were used to align the ball are further advanced towards the ball and thereafter employed to impart a predetermined amount of spin to the aligned ball. Alternatively, as depicted in FIG. 5, ball supports 28C and 28D can be brought into contact with the aligned ball as indicated by directional arrows R and S. Ball supports 28A and 28B are thereafter retracted as indicated by directional arrows T and U in FIG. 6, and ball supports 28C, 28D employed to apply a predetermined amount of spin to the ball.

Preferably, once the ball has been aligned, the pair of ball supports employed to apply a predetermined amount of spin to the ball, grip the ball more firmly so as to keep the same alignment. Typically, a pressure of twelve to eighteen kilograms and preferably fifteen kilograms would be employed. However, as above, an alternative gripping pressure could be determined by the skilled addressee.

Figure 7:
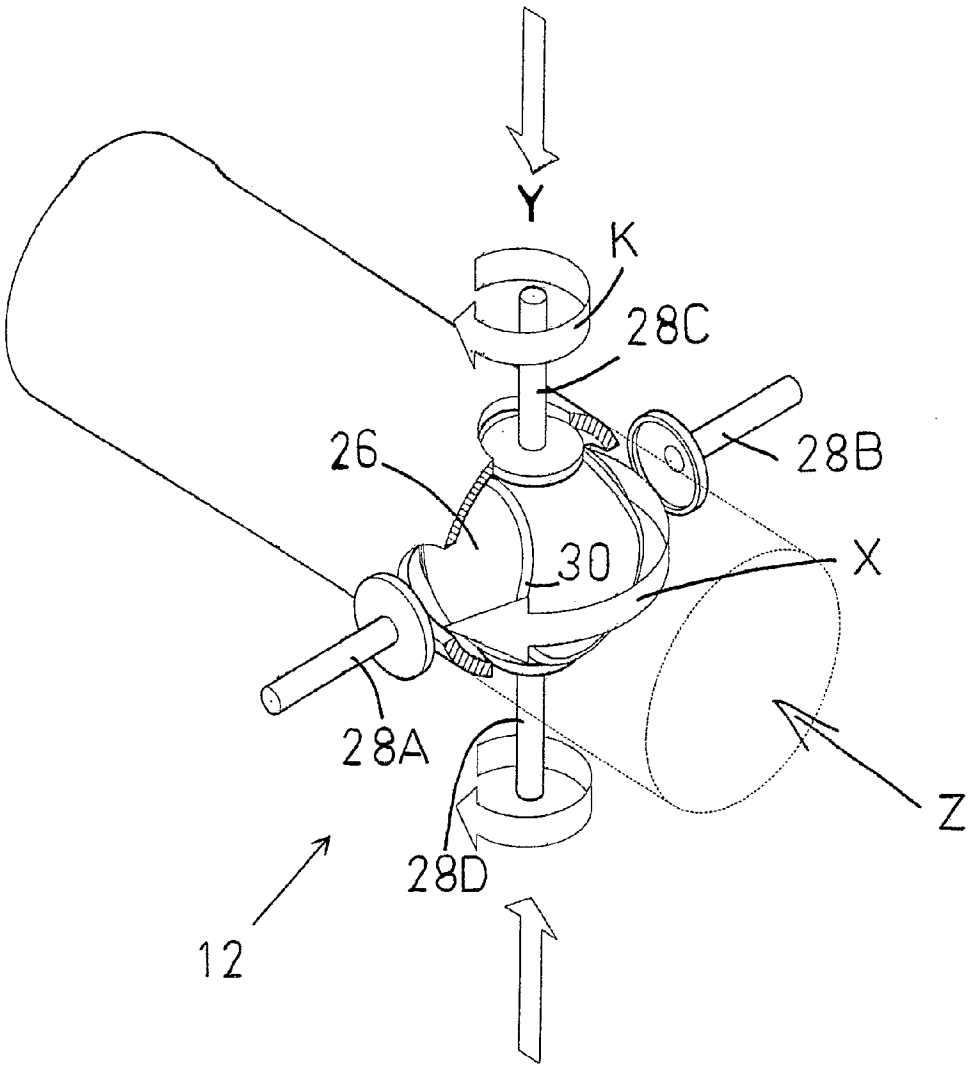

In applying a predetermined amount of spin to an aligned ball, an axis of rotation must first be selected. For example, FIG. 4 depicts the ball supports 28A, 28B spinning the ball in what is known as the "two seam" position, and which is explained in greater detail below. In contrast, FIG. 7 depicts the pair of opposing ball supports 28C, 28D gripping the ball and the ball being spun in the "four seam" position, also explained below. Ball supports 28C and 28D can also be employed to spin the ball in the two seam position, however this configuration is not depicted in the drawings.

Referring again to FIG. 4, if a ball is spun in a direction shown by arrow N about an axis M and propelled in the direction of Z, then the batter viewing the ball as it approaches will see the seam two times for each revolution of the ball about the axis M. This is called the two seam position.

Referring again to FIG. 7, if a ball is spun in a direction shown by arrow X about an axis Y and propelled in the direction of Z, then the batter viewing the ball as it approaches will see the seam four times for each revolution of the ball about the axis Y. This is called the four seam position.

In practice, ball supports 28C, 29D can be used to spin an aligned ball in the four seam position by advancing ball supports 28C, 28D towards an aligned ball being spun by ball supports 28A, 28B (which loosely grip the ball) until interaction of the seam of the ball with ball supports 28C, 28D prevents the ball from further rotating with 28A, 28B. Ball supports 28A, 28B are then withdrawn. Ball supports 28C, 28D are then rotated to spin the ball in the four seam position. It has been found that advancing ball supports 28C, 28D towards the rotating aligned ball stops the ball rotating at the point where the each of the pair of ball supports 28C, 29D cover two distinct sections of seam, as at this point the ball has a marginally greater circumference. Preferably, the aligned ball is rotated slowly by ball supports 28A, 28B. Alternatively, an electrical sensor can be employed to accurately position ball supports 28C and 28D on the ball, prior to being rotated in the four seam position.

Figure 8:
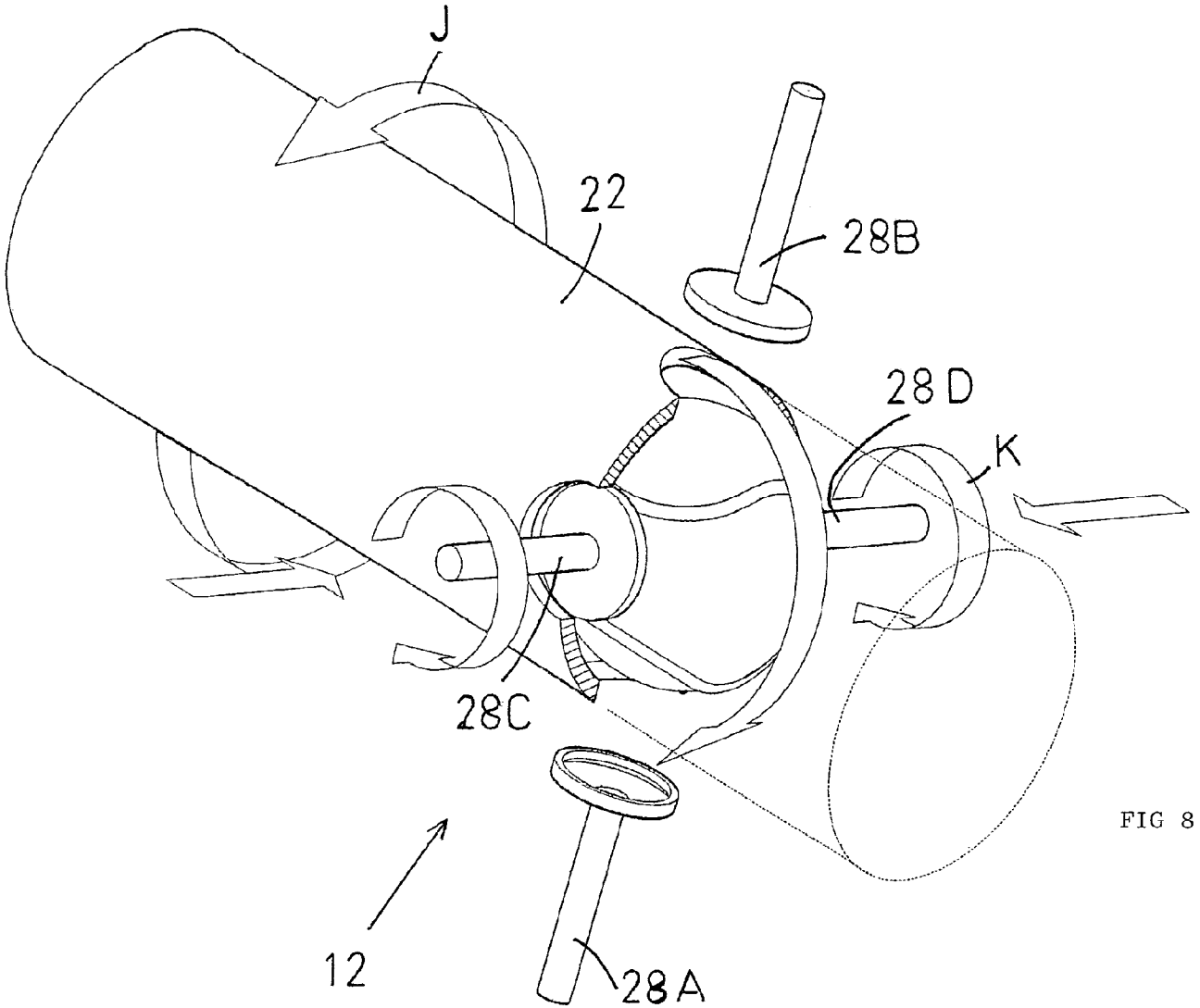
Figure 10B:
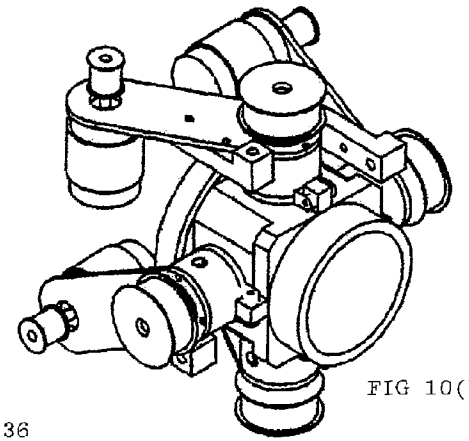
FIGS. 10(*a*) to 10(*c*) are perspective views of the ball spinning assembly of the present invention.
Figure 10C:
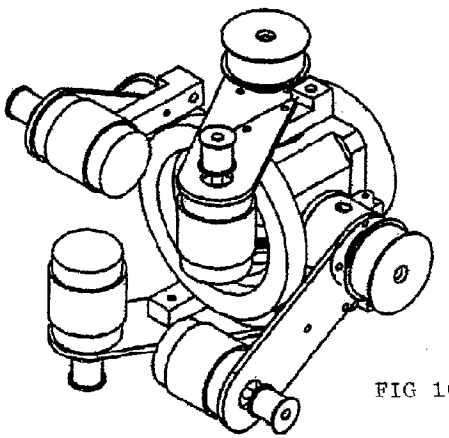
Figure 10A:
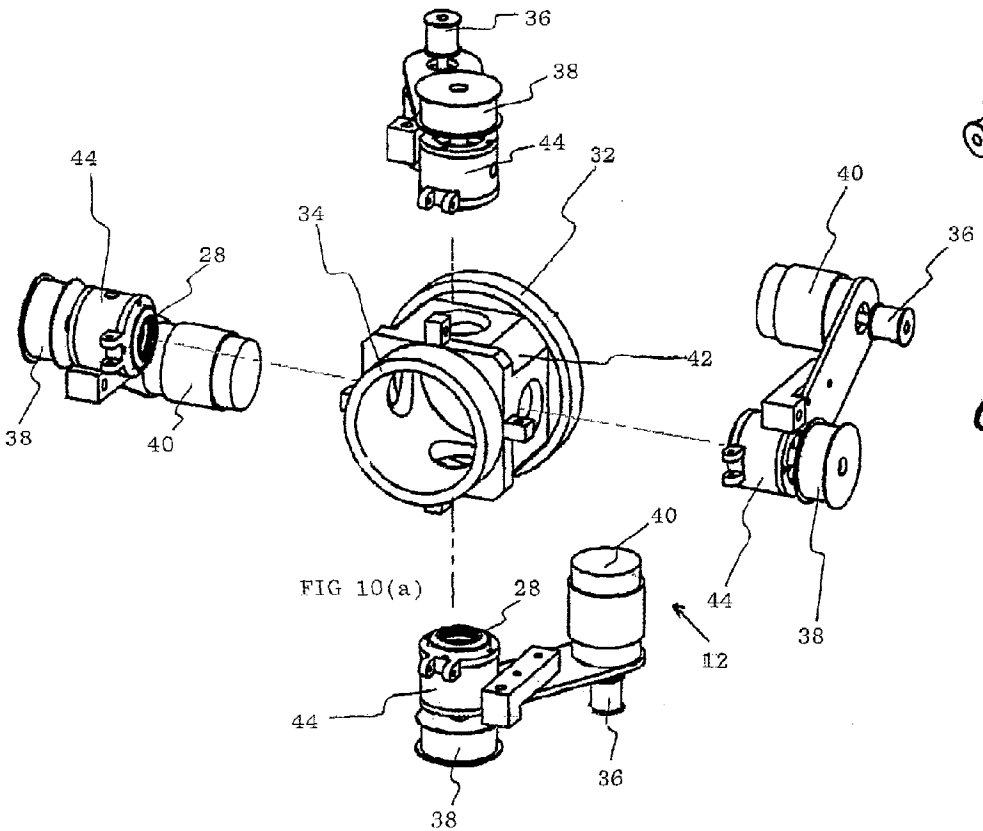

FIG. 8 depicts the aligned baseball spinning in the four seam position, but with the ball spinning assembly 12 rotated 90 degrees from that in FIGS. 2-7. Ball supports 28C, 28D now appear horizontal, rather than vertical. Bearings 32 and 34 (as depicted in FIG. 10) allow the barrel 22 and ball spinning assembly 12 to rotate relative to the remainder of the ball propelling machine 10 about the longitudinal axis of the barrel. This rotation allows the orientation of spin to change, for example, from topspin to sidespin. Rotation of the ball spinning assembly can be automated, for example by a motorised pinion and ring gear as discussed below. A control module may also be employed to vary the relative position of the assembly. FIG. 9 depicts the retraction of the ball supports 28C, 28D as indicated by directional arrows D and E, and a ball top spinning in the four seam position being fired from the barrel.

As stated above, the ball spinning assembly 12 can be made from metal, metal alloy or plastic, however steel is preferred. The ball supports 28A, 28B, 28C, 28D may be constructed of similar materials. Alternatively, it may be desirable to use different materials for different ball supports. For example, ball supports 28A, 28B may be aluminium, where supports 28C, 28D may be rubber or plastic and the stem of the ball supports may be manufactured from aluminium. According to the preferred embodiment, the ball supports have a substantially concave surface to contact the ball and enhance frictional drive between the supports and the ball.

FIGS. 10(*a*) to 10(*c*) depict the ball spinning assembly 12 according to the preferred embodiment of the present invention. Specifically, FIG. 10(*a*) depicts the housing of the ball spinning assembly 42, motors 40 and associated pulleys 36, ball supports 28 and associated pulleys 38 and pneumatic pistons 44. Pistons 44 are attached to housing 42 by hinge, and biased towards the closed position as depicted in FIG. 10(*b*) by a spring (not shown). Use of a hinge to connect pistons 44 and housing 42 allows the ball supports 28 to be manually withdrawn from their respective openings in housing 42, if necessary.

Motors 40 provide rotary motion to the ball supports 28 via a belt (not shown) between pulleys 36 and 38. In turn, the ball supports hold and rotate the baseball about an axis. Pneumatic pistons 44 advance and retract the ball supports from contact with a loaded ball. The pneumatic pistons can be employed to vary the amount of pressure applied by the ball supports on a loaded baseball in accordance with the method of the present invention. Alternatively, linear motors can be used to vary the amount of pressure applied by the ball supports on a loaded baseball.

The rotation of the motors can be clockwise or anticlockwise depending upon the direction of axial spin required on the ball when fired. By varying the speed of rotation of the motors, it is possible to vary the amount of spin imparted on the ball when fired. Further, as discussed above, the spinning assembly 12 and barrel can be rotated relative to the horizontal playing surface, so that balls with, for example, topspin or sidespin can be propelled toward the target.

Figure 11A:
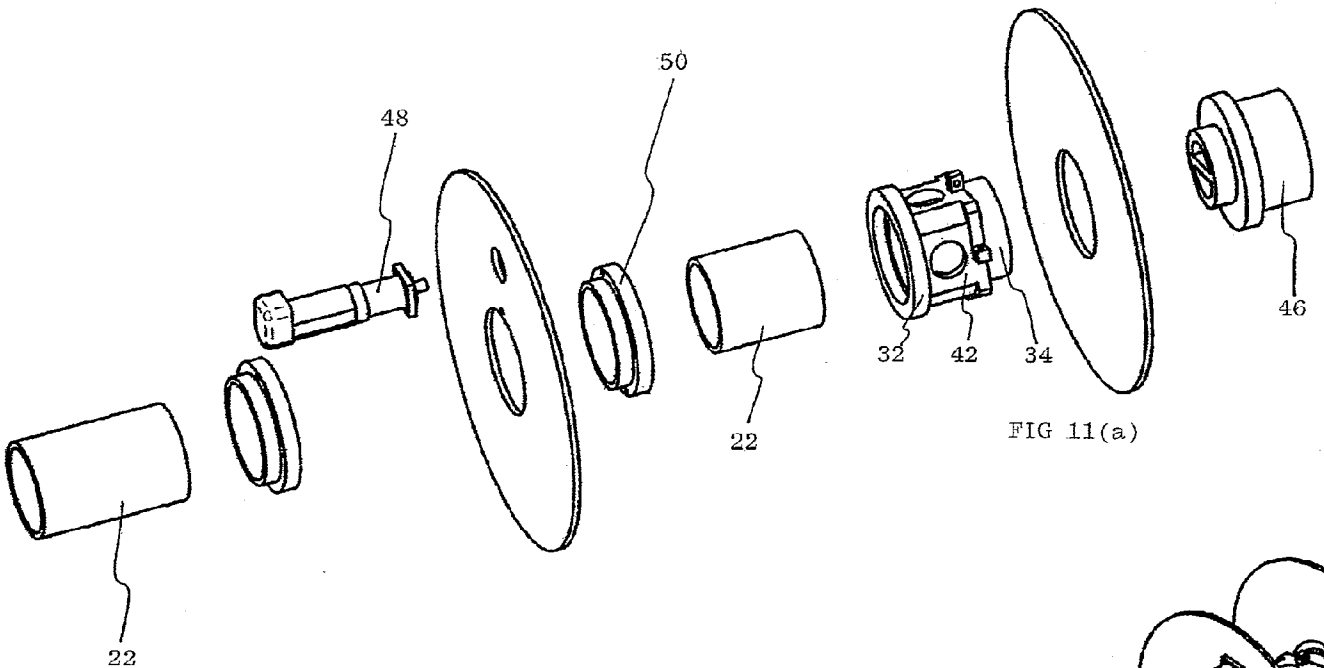
FIG. 11(*a*) is an exploded perspective view of the combined main barrel and ball spinning assembly of the present invention.
Figure 11:
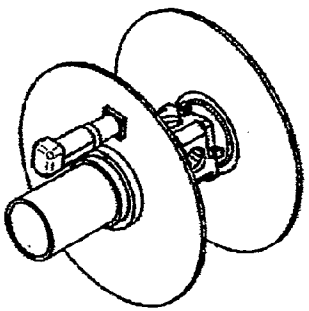
Figure 12C:
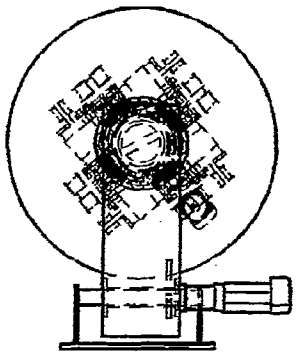
FIGS. 12(*a*) and 12(*d*) are perspective views of the combined ball spinning assembly, main barrel and mounting assembly of the present invention.
Figure 12E:
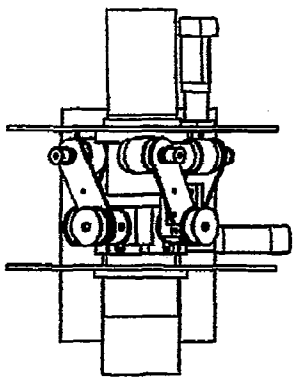
Figure 12B:
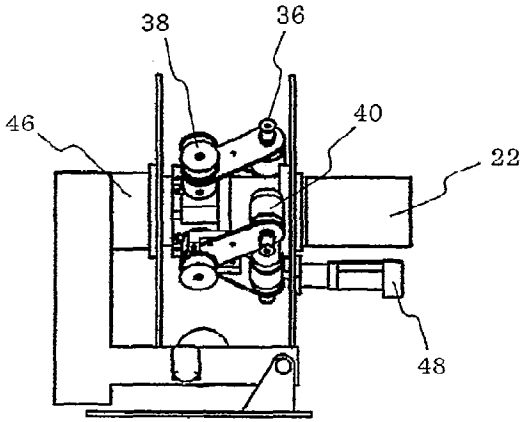
Figure 12D:
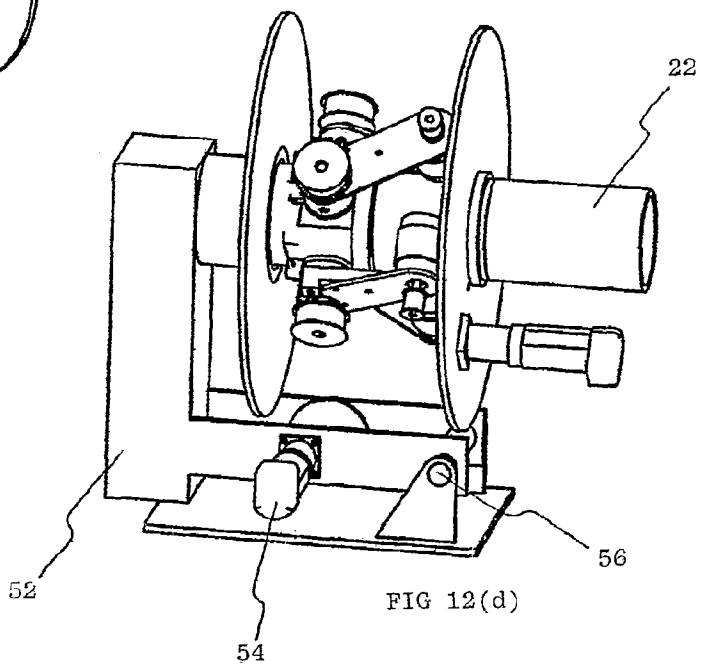
Figure 12A:
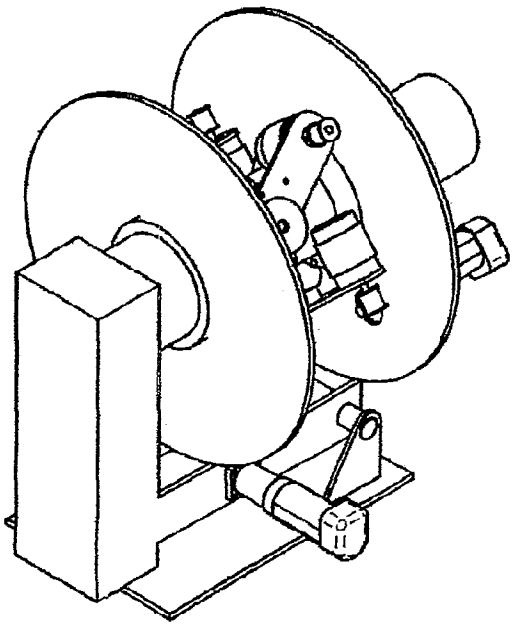

FIGS. 11(*a*) and 11(*b*) depict a configuration of the ball spinning assembly according to the present invention which allows the housing 42 of the ball spinning assembly to be rotated relative, to say, a horizontal playing surface. Specifically, motor 48 can be employed to rotate ring gear 50 and thus rotate the ball spinning assembly. Valve body 46 allows compressed air to propel a baseball spinning in the ball spinning assembly to be propelled from the machine.

FIGS. 12(*a*) to 12(*e*) depict the full assembly according to a preferred embodiment of the present invention. In addition to that depicted in FIG. 11, FIGS. 12(*a*) to 12(*e*) depict a support frame 52 that can be raised or lowered by motor 54 relative to pivot pin 56. This configuration allows for balls of different trajectory but identical spin to be propelled from the machine.

In use, a ball is placed in the open end of the barrel and allowed to roll into the ball spinning assembly. Once inside the ball spinning assembly the ball is aligned, spun at a predetermined rate of revolutions about a predetermined axis and subsequently propelled from the machine by compressed air toward the target. All of these functions are preferably linked to a suitable computer control module.

Figure 13A:
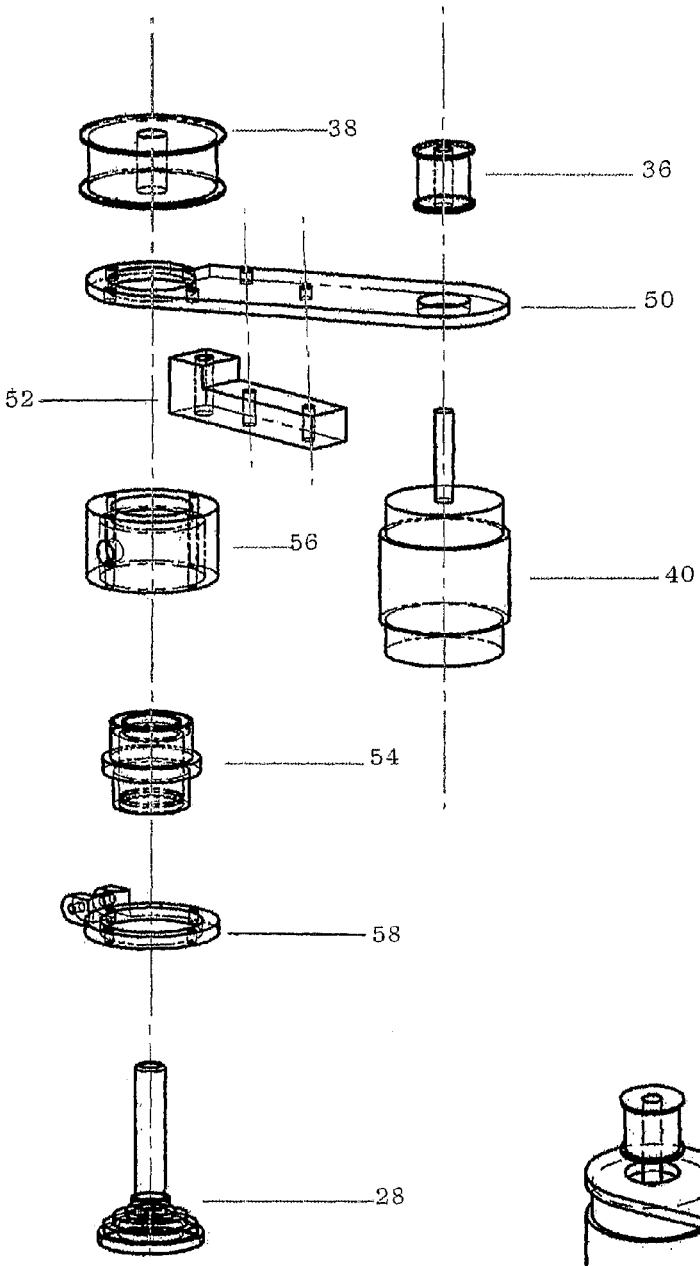
FIG. 13(*a*) is an exploded perspective view of the ball support and associated motor assembly of the ball spinning assembly of the present invention.
Figure 13B:
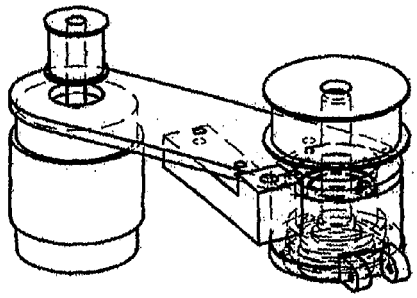

FIGS. 13(*a*) and 13(*b*) provide more detail of the ball support assembly of the preferred embodiment. FIG. 13(*a*) depicts an exploded view of the assembly in which the motor 40 and associated pulley 36 and mounting plate 50 of the ball support mechanism are identified. The pneumatic piston assembly includes a ball support 28, pivot ring 58, piston 54, cylinder 56, actuator housing 52 and pulley 38. In use, piston 54 acts to advance ball support 28 against a loaded ball.

Figure 14:
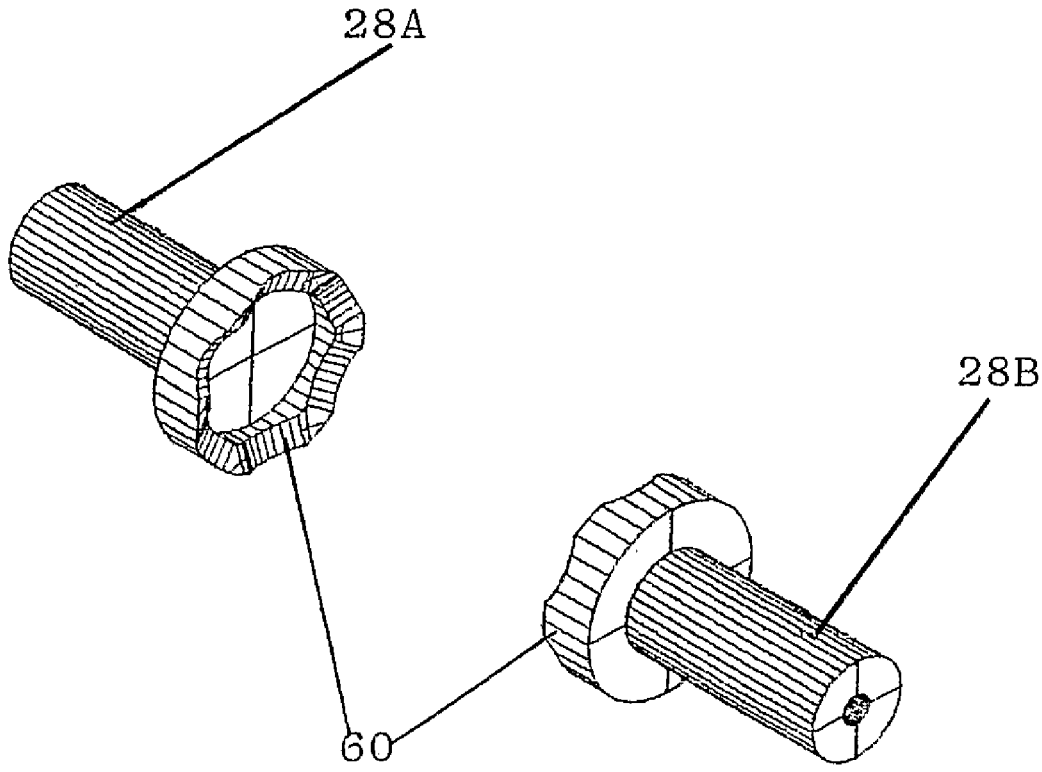

It will be apparent to the skilled addressee that the ball supports of the present invention can be constructed with other than smooth concave surfaces to contact the baseball. For example, as depicted in FIG. 14, the ball supports 28A and 28B can have adjacent scalloped or arcuate grooves 60 meeting at peaks on the rim of their concave face. These grooves are preferably approximately as deep as the height of the stitching which protrudes from the surface of a baseball. Ball supports 28C and 28D may be similarly configured. As stated earlier, the supports can be constructed from a combination of materials and in this regard, a non-stick surface may be employed on the cup-like faces of the supports to reduce the torque required from the motor, or motors, to position the ball.

It will be appreciated by one of skill in the art that the various functions of the baseball spinning assembly of the present invention can be placed under the control of a programmable control module. Further, the control module may be used in conjunction with a portable computer and/or remote control unit. Parameters that may be varied using such a device include, for example, the rate, direction and angle of rotation, and velocity of a propelled ball. In addition, the control module can be employed to collect statistics about an individual ball player. Moreover, subsequent training can be tailored to meet the individual needs of such a player. These devices and others would be readily apparent to the skilled person and are included within the scope of the present application.

Ideally, the ball receiver is provided with a signal so that it is known when a ball is about to be propelled. For example, a ball visible to the ball receiver may be rolled down a track into a feed tube moments before an actual ball is propelled. According to this embodiment, as a ball falls into the feed tube a sensor fires the ball that is waiting in the spin imparting means. Alternatively, a clear plastic tube may be employed. When the ball reaches the top of the clear tube, it falls into the feed tube and activates a sensor which fires the ball waiting in the spin imparting means. Alternative arrangements for signalling to the ball receiver that the ball is about to be propelled are known in the art and are included within the scope of the present invention.

It will also be appreciated by one of skill in the art, that the ball spinning assembly 12 of the present invention can be used in combination with a variety of ball loading and firing mechanisms. References to the specific loading and firing mechanisms discussed above are for illustrative purposes only.

It is to be understood that although the invention has been described with particular reference to specific embodiments thereof, the form of the invention shown and described in detail is to be taken as the preferred embodiment of same, and that various changes and modifications may be resorted to without departing from the spirit and scope of the invention as defined in the appended claims.

The invention claimed is:

1. A ball propelling assembly for propelling a ball having a seam, the assembly including:

a ball positioner having opposed ball supports which engage and rotate the ball which thereby moves relative to the ball supports until positioned relative thereto in a predetermined alignment;

a ball spinner having opposed ball supports which engage and spin the ball in the predetermined alignment, and a ball propeller which propels the spinning ball from the assembly along an axis of propulsion.

2. The bail propelling assembly of claim 1, wherein the ball spinner includes two pairs of opposed ball supports, the pairs being aligned to each other at right angles.

3. The ball propelling assembly of claim 2, wherein one of the opposed pairs comprises the pair of opposed ball supports in the ball positioner.

4. The ball propelling assembly of claim 2, wherein one of the opposed pairs comprises the pair of opposed ball supports in the ball spinner.

5. The ball propelling assembly of claim 1, wherein the ball supports can be advanced towards and retracted away from a loaded ball.

6. The ball propelling assembly of claim 1, wherein the assembly includes a motor which rotates and/or spins the ball supports.

7. The ball propelling assembly of claim 1, wherein the portion of each ball support that comes into contact with the ball has a substantially concave face with a plurality of adjacent scallops or grooves which meet at peaks on the rim of the face.

8. The ball propelling assembly of claim 1, wherein the predetermined alignment is either such that the ball is positioned to be propelled with a two seam spin, or is propelled with a four seam spin.

9. The ball propelling assembly of claim 1, wherein the predetermined alignment is such that the ball is not engaged by the opposed ball supports on the seam of the ball.

10. A method of propelling a ball having a seam, the method including:

engaging and rotating the ball by a ball positioner having opposed ball supports, the ball thereby moving relative to the ball supports until positioned relative thereto in a predetermined alignment;

engaging and spinning the ball engaged thereby in the predetermined alignment by a ball spinner having opposed ball supports, and propelling the spinning ball from the assembly along an axis of propulsion by a ball propeller.

11. The method of claim 10, wherein the ball is a baseball or softball.

12. An assembly for aligning a baseball in a baseball propelling machine, the assembly comprising at least one pair of opposing ball supports, wherein rotation of the ball supports causes a loaded baseball to rotate about a predetermined axis, wherein the pressure exerted by the ball supports on the baseball is insufficient to prevent the axis of rotation of the baseball changing whilst being rotated and the baseball adopting the predetermined axis of rotation and wherein a first pair of opposed ball supports firstly causes the baseball to rotate about a predetermined axis and thereafter a second pair of opposed ball supports apply a predetermined amount of spin to the baseball so as to be propelled in the four seam position.

13. The assembly of claim 12, wherein the first pair of ball supports are rotated at a different speed to the second pair of ball supports.

14. The assembly of claim 12, wherein the opposing pair of ball supports contact the baseball with two to six kilograms of pressure when aligning the baseball to rotate about a predetermined axis of rotation.

15. The assembly of claim 12, wherein the opposing pair of ball supports contact the baseball with twelve to eighteen kilograms of pressure when spinning the baseball in the two to four seam position.

16. An assembly for aligning a baseball in a baseball propelling machine, the assembly comprising at least one pair of opposing ball supports, wherein rotation of the ball supports causes a loaded baseball to rotate about a predetermined axis, wherein the pressure exerted by the ball supports on the baseball is insufficient to prevent the axis of rotation of the baseball changing whilst being rotated and the baseball adopting the predetermined axis of rotation and wherein a single pair of opposed ball supports firstly causes the baseball to rotate about a predetermined axis and thereafter apply a predetermined amount of spin to the baseball so as to be propelled in the two seam position and wherein the opposing pair of supports contact the baseball with twelve to eighteen kilograms of pressure when spinning the baseball in the two or four seam position and wherein the ball supports each have a concave face which have a plurality of adjacent scallops or grooves which meet at peaks on the rim of the faces of the ball supports.

17. A method of aligning a baseball in a baseball propelling machine comprising bringing a pair of opposing ball supports into contact with a baseball and rotating the ball supports until the baseball rotates about a predetermined axis, wherein the pressure exerted by the ball supports on the baseball is insufficient to prevent the axis of rotation of the baseball changing whilst being rotated and the baseball adopting the predetermined axis of rotation.

* * * * *